US005924717A

United States Patent [19]

Janisch et al.

[11] Patent Number: 5,924,717

[45] Date of Patent: Jul. 20, 1999

[54] CONTROL MECHANISM FOR A STIFFENING ARRANGEMENT

[75] Inventors: Andreas Janisch, Oeynhausen; Hubert Wuerthner, Hainburg/Donau; Karl Stritzl; Helmut Wladar, both of Vienna, all of Austria

[73] Assignee: HTM Sport-Und Freizeitgeraete Aktiengesellschaft, Schwechat, Australia

[21] Appl. No.: 08/614,165

[22] Filed: Mar. 8, 1996

[30] Foreign Application Priority Data

Mar. 10, 1995 [AT] Austria ..... 427/95

[51] Int. Cl.[6] ..... A63C 5/07

[52] U.S. Cl. ..... 280/602

[58] Field of Search ..... 280/602, 601, 280/607

[56] References Cited

U.S. PATENT DOCUMENTS

| | | | |
|---|---|---|---|
| 2,258,046 | 10/1941 | Clement . | |
| 4,221,400 | 9/1980 | Powers . | |
| 4,300,786 | 11/1981 | Alley . | |
| 5,251,923 | 10/1993 | Stepanek et al. | 280/602 |
| 5,301,976 | 4/1994 | Stepanek et al. | 280/602 |
| 5,362,085 | 11/1994 | Stepanek et al. | 280/602 |

FOREIGN PATENT DOCUMENTS

| | | | |
|---|---|---|---|
| 1 109 560 | 1/1956 | France . | |
| 1 118 857 | 6/1956 | France . | |
| 1170571 | 1/1959 | France | 280/602 |
| 2 448 360 | 5/1980 | France . | |
| 2 649 902 | 3/1992 | France . | |
| 2 689 411 | 6/1994 | France . | |
| 2 690 078 | 7/1994 | France . | |
| 1 298 024 | 2/1970 | Germany . | |
| 33 15 638 | 12/1983 | Germany . | |
| 91 16 875 | 6/1994 | Germany . | |
| 459 026 | 8/1968 | Switzerland . | |
| 94/08669 | 4/1994 | WIPO . | |

*Primary Examiner*—Eric D. Culbreth
*Attorney, Agent, or Firm*—Flynn, Thiel, Boutell & Tanis, P.C.

[57] ABSTRACT

The invention relates to an arrangement for changing the hardness, elasticity or rigidity of a sliding device for snow, which sliding device has a level of convexity which is predetermined during manufacture, having a stiffening device which can be fitted on the sliding device and can be changed, in terms of its action on the sliding device, by a control mechanism. The aim of the invention is, by changing the level of convexity, to be able to adapt the travelling properties of the sliding device to the respective skiing/snowboarding conditions in a particularly effective manner. This aim is achieved according to the invention in that a two-part stiffening device is arranged on the upper side of the sliding device, the sections of said stiffening device being connected to one another at the point of division by means of a spring system, and one section of the stiffening device being in engagement with a control mechanism by means of which the level of convexity of the sliding device, in relation to the non-loaded state thereof, can be set manually in two directions.

11 Claims, 11 Drawing Sheets

CONTROL MECHANISM FOR A STIFFENING ARRANGEMENT

FIELD OF THE INVENTION

The invention relates to an arrangement for changing the hardness, elasticity or rigidity of a sliding device, in particular a downhill ski or snowboard, according to the preamble of claim 1.

BACKGROUND OF THE INVENTION

An arrangement of the type mentioned in the introduction has been disclosed by French Patent Specification 1,118,857. This known arrangement comprises two compression bars 2 which can be displaced with respect to one another counter to the force of a compression spring 7 (see, in particular, FIGS. 5–7). The prestressing of the spring can be changed by an adjustment device provided with a manipulation means 17, as a result of which the bending properties of the ski are changed. In all the embodiments, as is disclosed by FIG. 3 of this document with reference to page 3, left-hand column, first full paragraph, use is made exclusively of compression springs, the ski also being subjected exclusively to compressive loading. Subjecting the ski to tensile loading, as is illustrated in FIGS. 10 and 11 of the French patent specification, would require a corresponding configuration of the springs 5, as is described on page 4, left-hand column, following lines 44. Such a configuration, however, is not disclosed in French Patent Specification 1,118,857. The measure of permitting tensile forces to be exerted on the ski according to FIG. 2 of this French patent specification was, in accordance with the description on page 2, right-hand column, following the third line from the end, the subject matter of an earlier application (French Patent Specification 1,109,560 by the same inventor).

As has already been outlined, compression springs are exclusively illustrated and described in the more recent French Patent Specification (1,118,857). The previously mentioned sentence concerning the fact that one would have to configure the springs correspondingly in order to achieve transmission of tension can be best understood in conjunction with the solution described above and contained in the earlier French patent specification mentioned in the more recent French patent specification. For this purpose, one of the spring systems, for the sake of simplicity this being the spring system according to FIG. 9, would have to be used instead of the cable lines (2 and 3), it being the case that transmission of tension could also then take place by adjustment of the screw 4 by means of the compression bars and/or screw-bolts. It would, however, be necessary for this purpose to retain the entire control system according to FIG. 2 of French Patent Specification 1,109,560 and, in addition, to install a spring system according to FIG. 9 on both sides. This would mean that a total of three manipulation means would have to be actuated, namely the adjustment screw 4 and each cylinder 27. Correspondingly, with the installation of a spring system according to FIG. 6 or FIG. 8, in each case one manipulation means 17 would be additionally required.

Moreover, French Patent Specification 1,118,857 describes a stiffening device with a compression bar located on the upper side of the ski, the adjustment spindle being represented as being located spatially above or beneath the upper side of the ski. The configuration of the compression bar as a rack element, just as a sunken configuration and the articulation of the racks, results in a considerable degree of manufacturing expenditure.

Another arrangement is disclosed in German Patent Specification 1,298,024, in accordance with which a camactuated adjustment system makes it possible to change the hardness of the ski via push rods. The push rods are fitted beneath the upper side of the ski and they are set by means of cams or threaded spindles. On account of the discontinuous cam curvature, the setting force is greater than the fixing force when the adjustment system is actuated, this resulting in an additional exertion of force being necessary. Furthermore, the installation of said known arrangement in the body of the ski is a laborious task and can only be carried out in the factory.

Precurved bars are described in U.S. Pat. No. 4,221,400. Said bars are fitted in cylindrical bores which run within the ski, along the direction of the longitudinal axis. These bars are rotated in order to change the curvature, hardness and rigidity of the ski. The simultaneous actuation of a plurality of bars involves a high degree of outlay, added to which is the fact that there is a considerable exertion of force.

U.S. Pat. No. 4,300,786 discloses exchangeable stiffening bars which are fitted on the sides of the ski and influence the flexibility of the ski as desired. However, exchanging the bars may itself be regarded as problematical because a multiplicity of stiffening bars have to be carried along for the various skiing/snow boarding conditions.

German Offenlegungsschrift 3,315,638 describes a stiffening device with a tension band which runs essentially parallel to the upper side of the ski, the stiffening forces being introduced into the ski by the tension band via vertically arranged adjustment devices.

French Offenlegungsschrift 2,448,360 specifies a system which is similar to this. Here, there is provided in the front region of the ski a stiffening device which is elevated in the vertical direction and can involve performance-related risks and problems with dirt build-up in the stiffening device.

In U.S. Pat. No. 2,258,046, a divided stiffening band is actuated by a horizontally mounted circular eccentric body. Actuation takes place via a lever, by means of a boot. This configuration gives some protection against the ingress of snow, whereas the introduction of force into the ski requires two additional plate-like parts.

A further known technical solution is specified in French Patent Specification 2,689,411, in the case of which a two-part stiffening body which is divided in its center and is connected elastically or rigidly to the upper side of the ski is provided. Here, in order to change the hardness and rigidity of the ski, use is made of the type of gap formation between the front and rear parts of the stiffening body. The insertion of elastic elements into the gap achieves stepped bending characteristics in one direction, but it is not possible for the user to change the rigidity of the ski voluntarily.

French Patent Specification 2,690,078 strengthens the ski dynamically in one direction during travel by means of a toggle lever and by way of the heel pressure, exerted by the rear part of the ski boot, which acts on the stiffening device. German Utility Model 91 16 875.9 describes a bearing-plate arrangement in the case of which the bearing plate is stiffened by a cam plate or a centrifugal weight. WO94/08669 discloses a stiffening bar which is fitted in an elevated manner against the upper side of the ski and permits continuous adjustment via a threaded adjustment disk.

French Patent Specification 2,649,902 discloses a stiffenable bearing plate which is fitted in an elevated manner with respect to the upper side of the ski, is mounted elastically in the direction of the axis of the ski and is intended for a complete safety binding.

In the number of solutions outlined above, additional appliances (levers or similar small tools) are required for adjustment purposes, and carrying these additional appliances along during travel is both obstructive and seems questionable from a safety point of view. In addition, in certain embodiments, there is still the possibility of icing up, this resulting in the actual function of the adjustment means being restricted. Likewise, it is not possible, in all solutions, to change the level of convexity to a sufficient degree.

SUMMARY OF THE INVENTION

The object of the invention is to provide an arrangement for changing the level of convexity, and thus the hardness, elasticity or rigidity of a sliding device of the type mentioned in the introduction. As a result of the level of convexity being changed, the intention is for it to be possible to better adapt the travelling properties to the skiing/snowboarding conditions than does the prior art.

The object is achieved by a novel stiffening device having a two-part stiffening device arranged on the upper side of the sliding device, the sections of said stiffening device being connected to one another at the point of division by means of a spring system, and one section of the stiffening device being in engagement with a control mechanism by means of which the level of convexity ($h_1$) of the sliding device, in relation to the non-loaded state thereof, can be set manually in two directions. The configuration according to the invention makes it possible not only for the control mechanism to be actuated manually, but also, by virtue of the configuration of the control mechanism, for the level of convexity, and thus the hardness, elasticity or sliding capacity, of the sliding device to be adjusted continuously. According to the invention, the level of convexity is adjustable in two directions, that is to say bidirectionally, by the two provided spring systems.

Apart from the fact that, in the cable sections (2 and 3) according to FIG. 2 of the earlier French patent, an installation of the compression-spring system is a laborious task and may even be impossible due to the lack of space, such a technical solution as is disclosed in the invention is not only novel, but is also inventive over the established prior art. The measure of the two sections of the stiffening device being supported with respect to one another by a spring system such that the ski is subjected to compressive loading by virtue of a manipulation mechanism being actuated in one direction, and is subjected to tensile loading by virtue of the manipulation mechanism being actuated in the other direction, is also not suggested to the person skilled in the art by a combination of the two French patent specifications.

Further advantageous and inventive configurations are disclosed herein.

BRIEF DESCRIPTION OF THE DRAWINGS

The invention will now be described in more detail with reference to the drawing, in conjunction with a plurality of exemplary embodiments. In the drawings.

DETAILED DESCRIPTION

Figure 1:
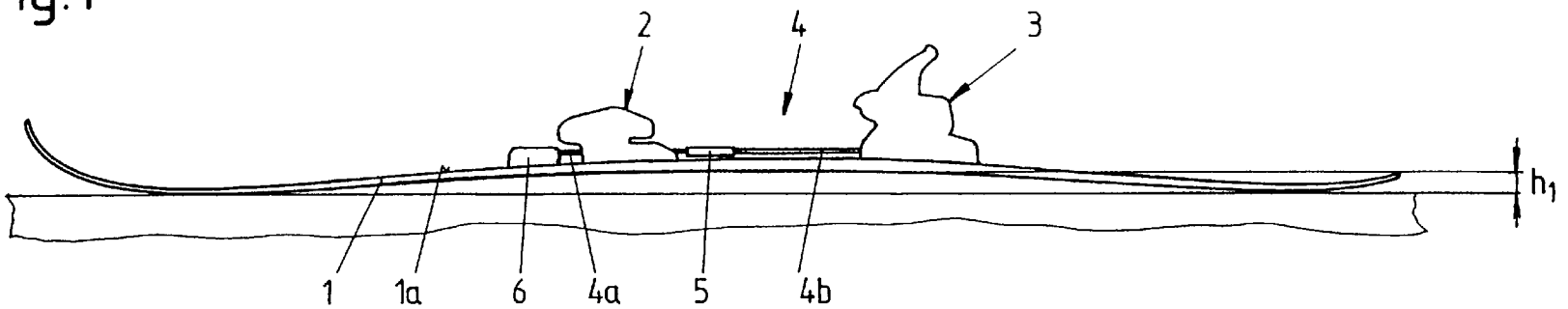
FIG. 1 shows a side view of the ski with a stiffening device with the level of convexity corresponding to a non-actuated control mechanism.

FIGS. 1 to 4 show schematic representations of a ski 1, on the upper side 1*a* of which a front jaw 2 and a heel-retaining means 3 are fastened. Furthermore, a stiffening device 4 which is divided by a spring system 5 is fitted on the ski 1, the rear section 4*b* of said stiffening device 4 being fastened, by means of its end, on the upper side 1*a* of the ski, in the present case in the immediate vicinity of the heel-retaining means 3. The front section 4*a* passes through the front jaw 2 and its end section is in engagement with a control mechanism 6 fixed to the ski.

Figure 2:
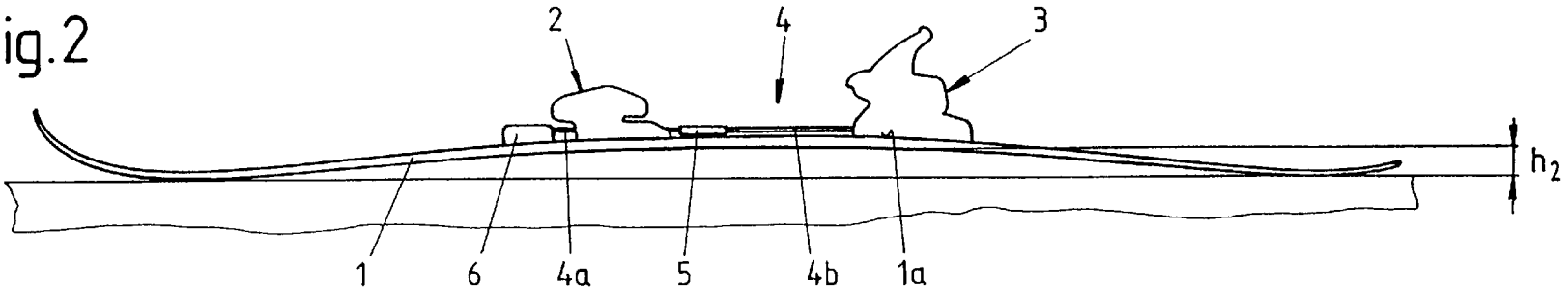
FIGS. 2 and 3 show the ski with a stiffening device once it has been moved into two different positions by virtue of the control mechanism being actuated FIG. 4 showing the plan view of FIG. 1.
Figure 3:
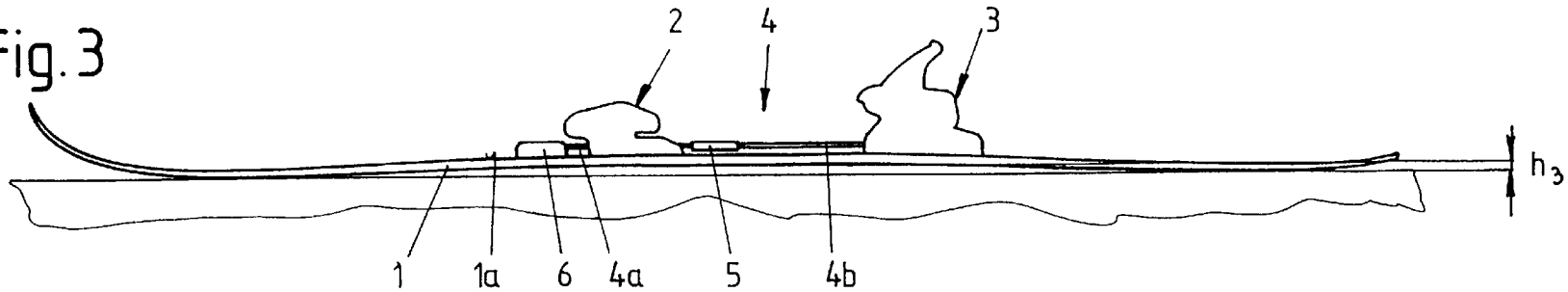
Figure 4:
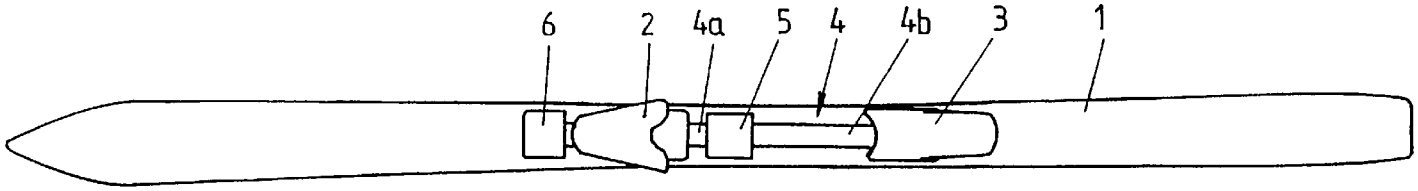

In a known manner, each ski has a so-called level of convexity $h_0$ (not shown separately in the drawing) which is determined in the factory. FIG. 1 shows the ski 1 with the above-mentioned components located thereon, with the level of convexity $h_1$ when the control mechanism 6 is in the non-active position. Below, the non-active position is also occasionally called the neutral position. FIG. 2 shows the ski 1 in a position in which the control mechanism 6, in relation to its neutral position, moves the ski by compression into an increased level of convexity $h_2$. FIG. 3 deals with the position of the control mechanism 6 which corresponds to the level of convexity being reduced to $h_3$ with respect to that of the neutral position with the level of convexity $h_1$. With the device, shown in FIGS. 2 and 3, of adjusting the level of convexity in two directions, the ski can be adapted to the respective skiing/snowboarding conditions as the user desires.

According to FIGS. 5 to 10, the control mechanism 6 comprises a basic body 7 which is fastened on the ski 1, by screws 8 which are only schematically indicated, and in which the stiffening device 4 is guided in a horizontally sliding manner by its front section 4*a*. An eccentric body 9 acting as a force transmission mechanism has two parts which are offset with respect to one another in the vertical direction and are concentric with respect to the center axis 18, namely a top part 9*a* and a bottom part 9*b*, between which the actual eccentric part 9*d* is arranged. The eccentric body 9 is mounted in the basic body 7 by means of the two mutually concentric parts 9*a* and 9*b* and is received, by its eccentric part 9*d*, into an elongate recess 4*c* of the front section 4*a* of the stiffening device 4. Arranged on the basic body 7 is manipulation means, here a hand wheel 10, which is independent of said basic body and, received in an elongate recess 9*c* of the top part 9*a* of the eccentric body 9 by means of a coupling pin 10*a* fastened on said hand wheel, produces a positively locking connection between the eccentric body 9 and the hand wheel 10.

Figure 5:
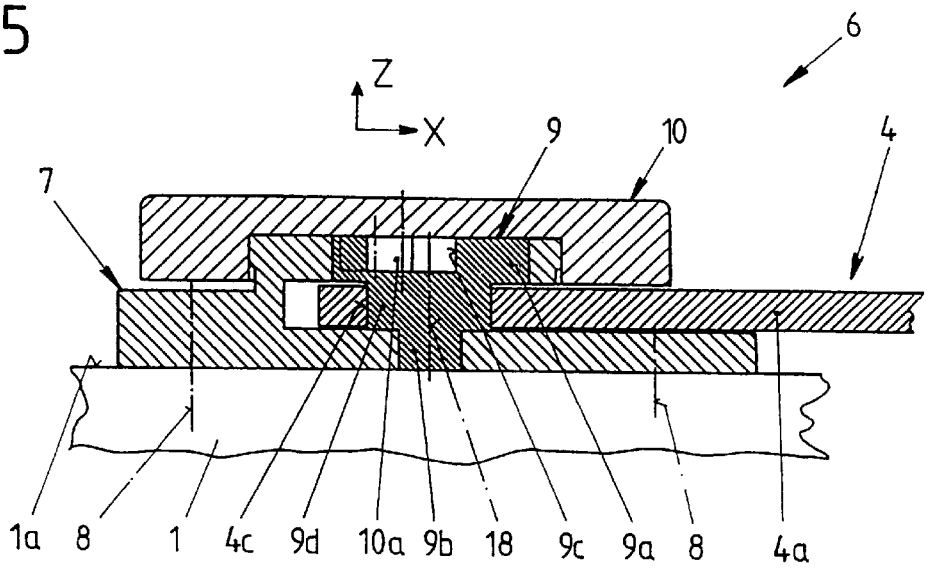
FIG. 5 shows a longitudinal section of a first exemplary embodiment of a control mechanism along line V—V of FIG. 6 with the control mechanism in the neutral position.
Figure 6:
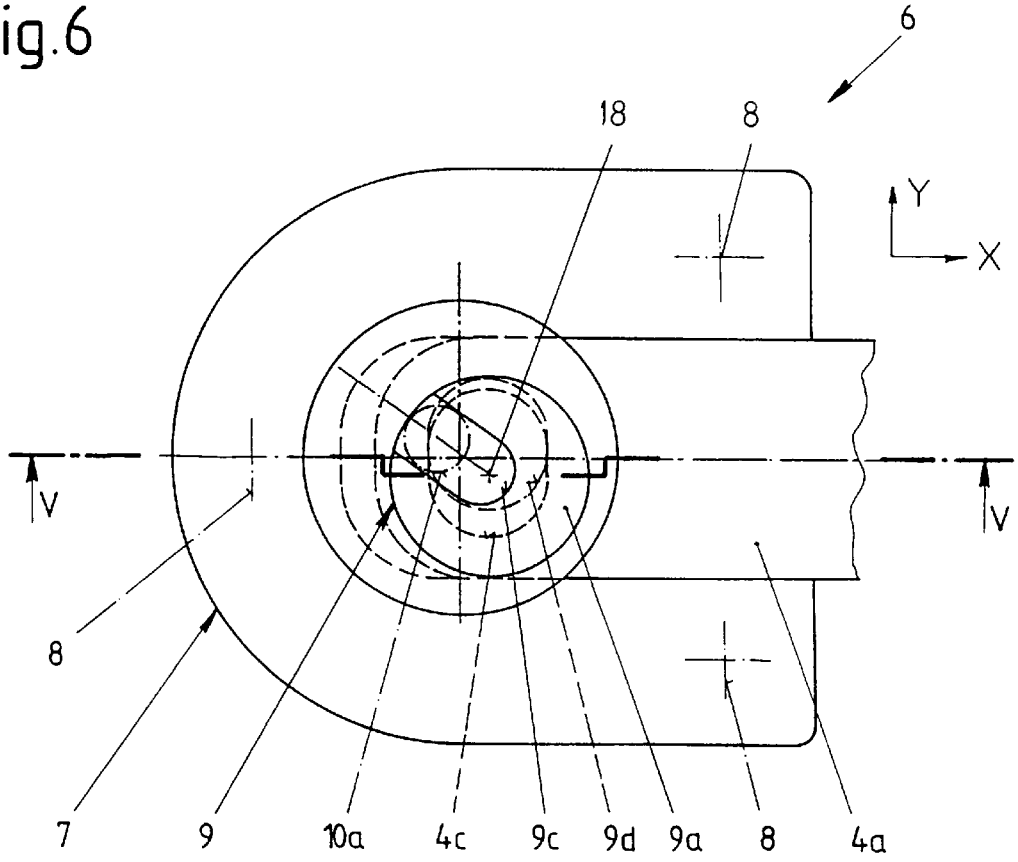
FIG. 6 shows a plan view of FIG. 5, but without hand wheel.
Figure 7:
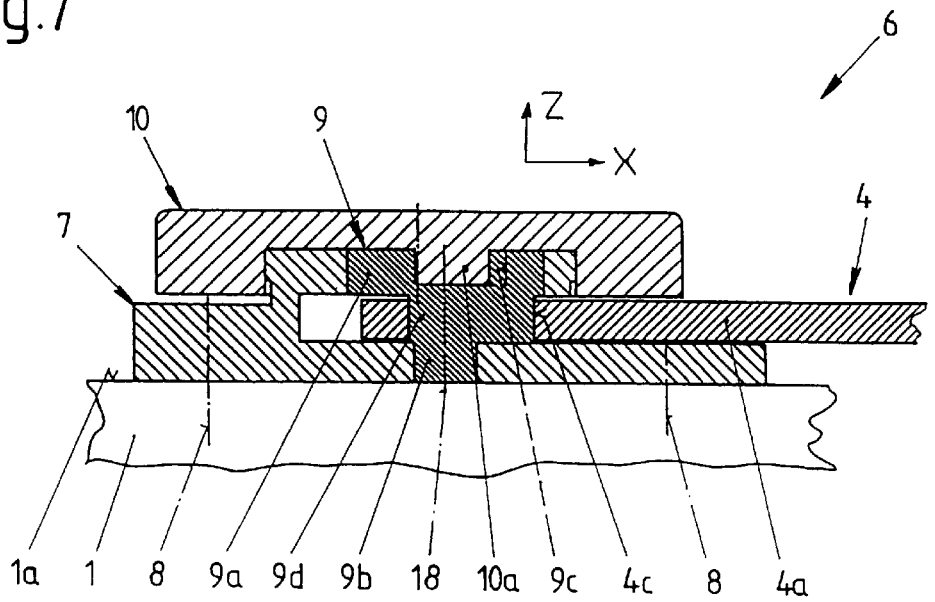
FIG. 7 shows a section of the first exemplary embodiment of a control mechanism along line VII—VII in FIG. 8 with the control mechanism being in a position corresponding to the position of the ski according to FIG. 2.
Figure 8:
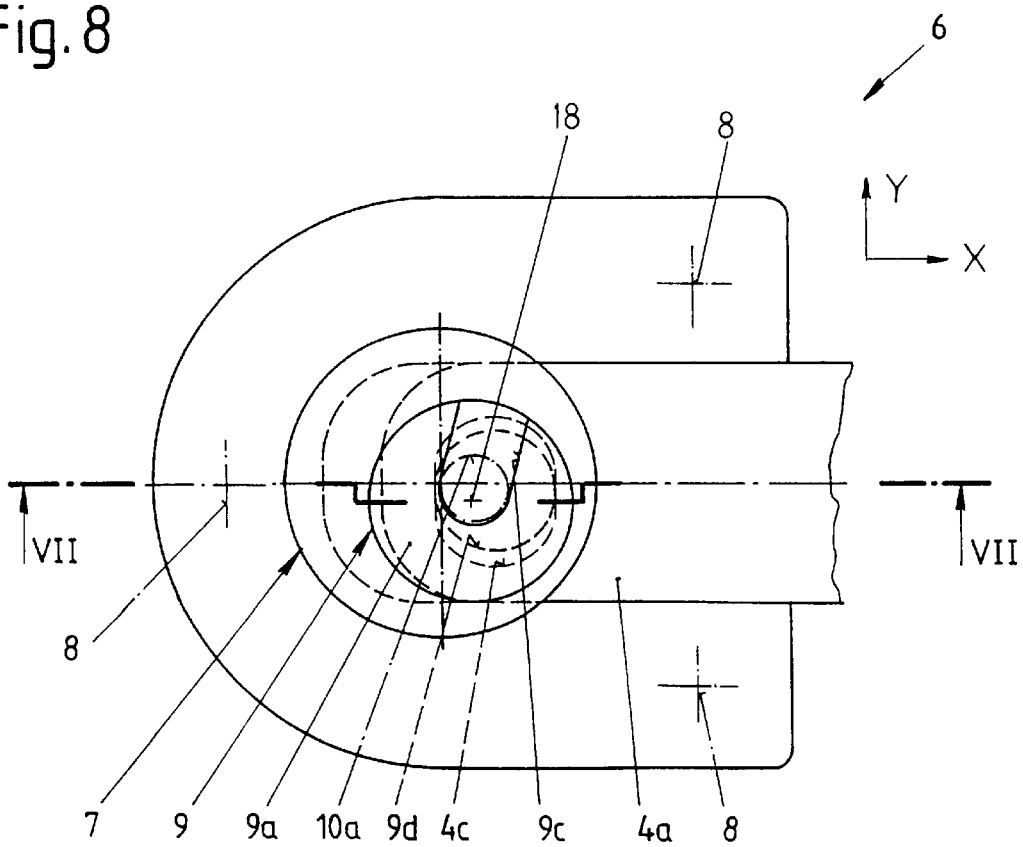
FIG. 8 shows a plan view of FIG. 7, the hand wheel having been removed.

In the neutral position of the control mechanism 6 according to FIGS. 5 and 6, the eccentric part 9*d* has its longitudinal axis normal to the longitudinal axis of the stiffening device 4. By virtue of the hand wheel 10 being rotated, the eccentric body 9 is rotated about its axis as a result of the interaction between coupling pin 10*a* and elongate recess 9*c*. Depending on the direction of rotation, the eccentric part 9*d* thus moves the front section 4*a* of the stiffening device 4 to the left or right. If the hand wheel 10 is rotated clockwise, then, as FIGS. 7 and 8 show, the stiffening device 4 is moved to the right, i.e. to the rear. In this position of the control mechanism 6, the ski 1 is located in the position according to FIG. 2 and has the level of convexity $h_2$.

Figure 9:
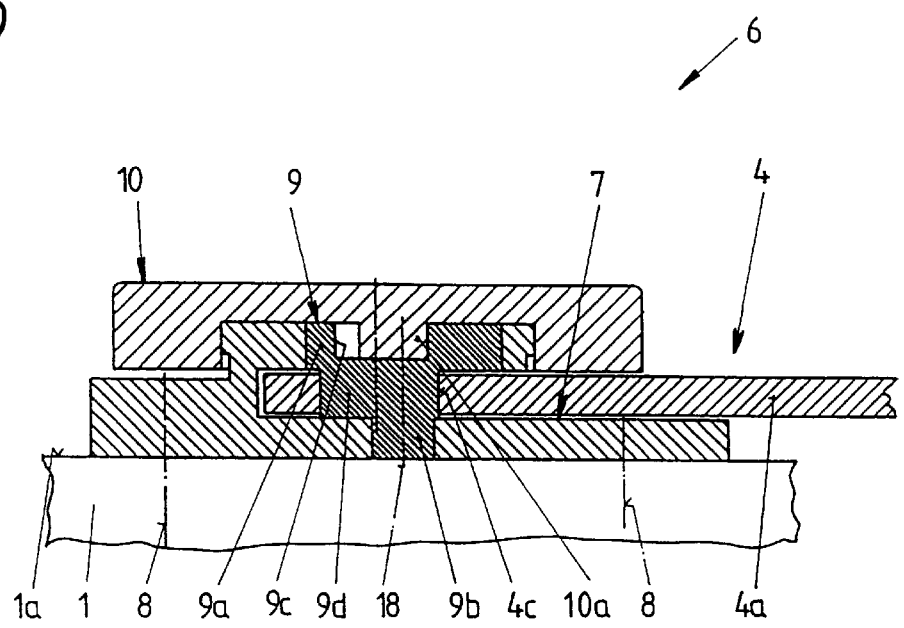
FIG. 9 shows a longitudinal section of the first exemplary embodiment of a control mechanism along line IX—IX of FIG. 10 with the control mechanism being in a position corresponding to the position of the ski according to FIG. 3.
Figure 10:
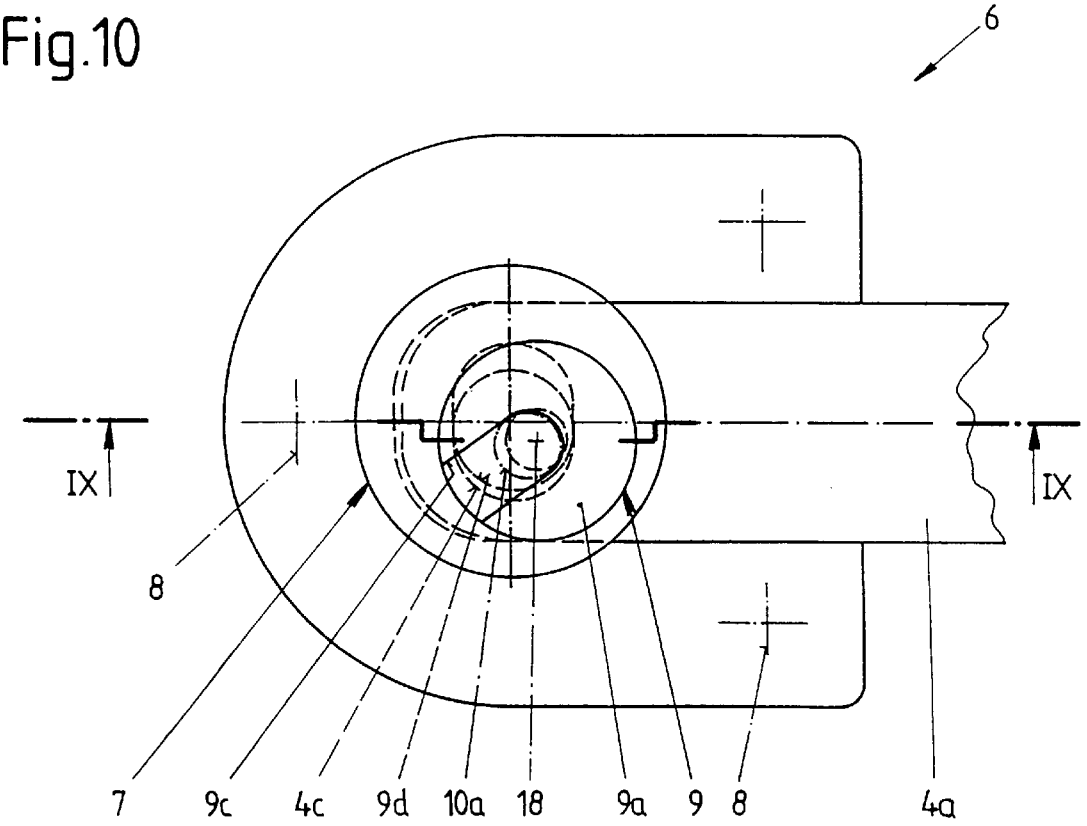
FIG. 10 shows a plan view of FIG. 9 without hand wheel.

By virtue of the hand wheel 10 being rotated counterclockwise, the stiffening device 4 passes, according to FIGS. 9 and 10, into a position in which it has been displaced to the left, i.e. to the front. In this position of the control mechanism 6, the ski 1 is located in the position according to FIG. 3 and has the level of convexity $h_3$.

Figure 11:
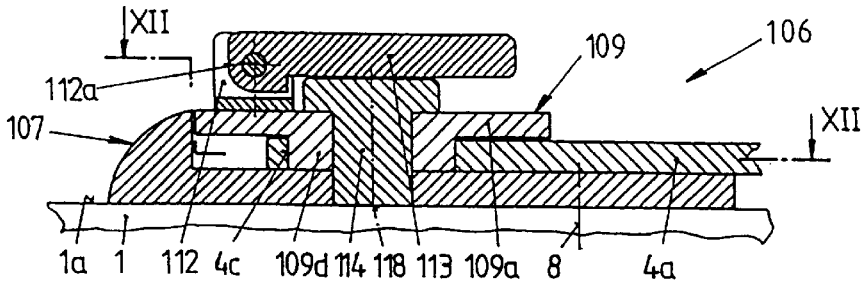
FIG. 11 shows a longitudinal section of a further exemplary embodiment along line XI—XI of FIG. 12.
Figure 12:
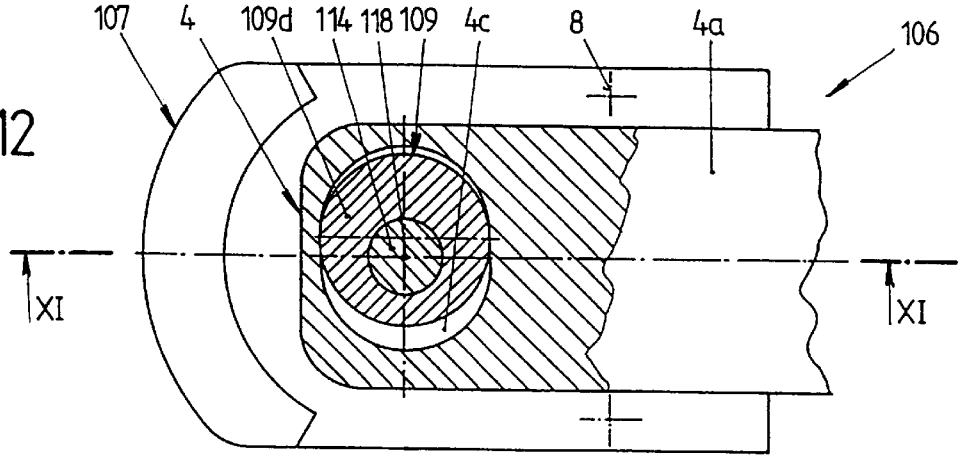
FIG. 12 shows a section of the further exemplary embodiment along line XII—XII of FIG. 11.

According to FIGS. 11 and 12 of the second embodiment of the control mechanism 106, the basic body 107 thereof is likewise fixed to the ski 1 by means of screws 8 which are only schematically indicated. In this embodiment, the control mechanism 106 has an eccentric body or force-transmission mechanism 109 with a centering bolt 114 passing through the latter. Located in the front section 4*a* of the stiffening device 4 is an oval recess 4*c* into which the eccentric part 109*d* engages. The eccentric body 109 is mounted in the basic body 107 by the centering bolt 114. A pivot bearing 112 having a swing-action lever 113 which can be pivoted around a transverse pin 112*a* is provided on the top part 109*a* of the eccentric body 109. In the swung-out state, the swing-action lever 113 makes it possible for the eccentric body 109 to be rotated easily about a vertical axis 118 of the centering bolt 114 in two directions with respect to its neutral position, as a result of which the front section 4*a* of the stiffening device 4, connected in a positively locking manner to the eccentric part 109*d* by its oval recess 4*c*, likewise carries out corresponding relative movements with respect to the basic body 107, as a result of which the level of convexity of the ski, as has already been described, can be set bilaterally.

Figure 13:
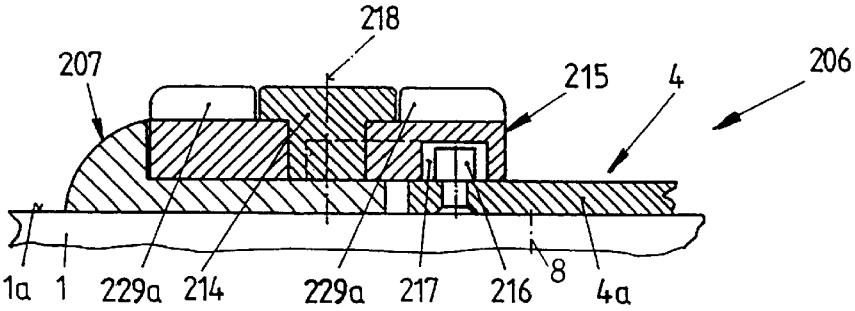
FIG. 13 shows a longitudinal section of a third variant of the control mechanism along line XIII—XIII of FIG. 14.
Figure 14:
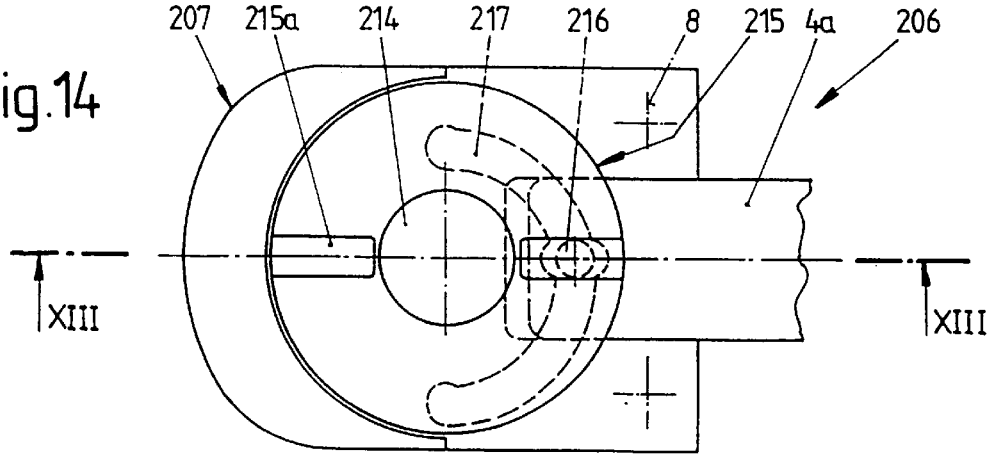
FIG. 14 shows the plan view of FIG. 13.

In the third exemplary embodiment of the control mechanism 206 according to FIGS. 13 and 14, an adjustment disk or force transmission mechanism 215 is mounted in a basic body 207 which is independent of the ski 1 and is connected thereto by screws 8 which are only schematically indicated. Manipulation means 215*a* rotates the adjustment disk 215 about the vertical axis 218 of the centering bolt 214. The manipulation means 215*a*, includes grip tabs 229*a* extending vertically from adjustment disk 215. A constantly rising, eccentric control groove 217 is formed in said adjustment disk 215. A driver 216, which is fitted in an elevated manner on the front section 4*a* of the stiffening device 4, engages into the control groove 217 with play. If the adjustment disk 215 is then rotated around the centering bolt 214, by the grip tabs 229*a*, then the disk 215 engages and moves the driver 216 and thus also the stiffening device 4 according to the configuration of the constantly rising contour of the control groove 217 to carry, out a movement in the direction of the longitudinal axis of the stiffening device 4. As a result of the rigid connection between the front section 4*a* of the stiffening device 4 and the driver 216, the movements of the stiffening device 4 take place, both in terms of size and direction, in accordance with those which have been caused by the adjustment disk 215.

Figure 15:
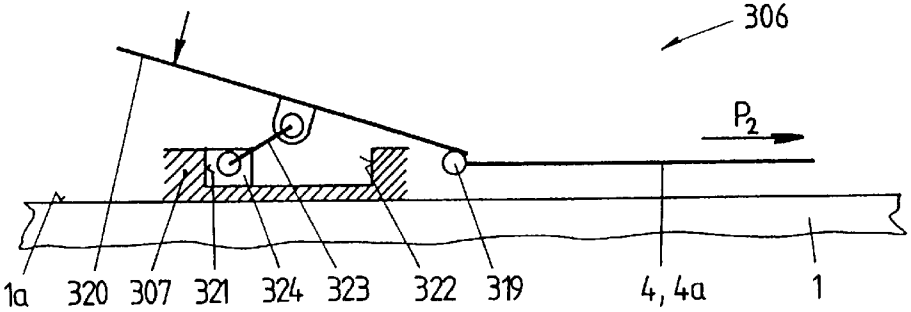
FIGS. 15 and 16 show schematic representations of the fourth variant of a control mechanism.
Figure 16:
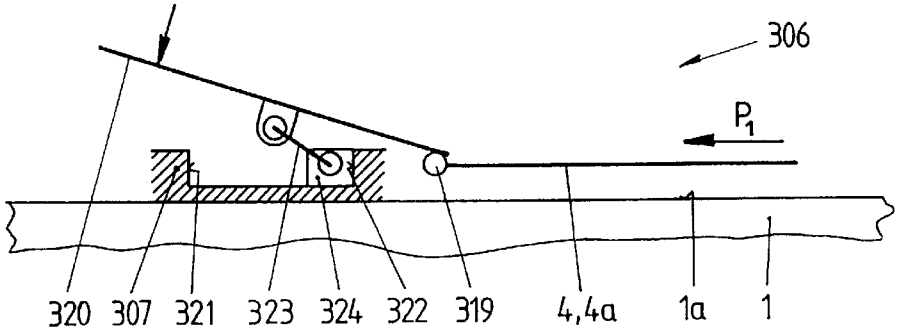

In the fourth embodiment of the control mechanism 306 according to FIGS. 15 and 16, a basic body 307 is, once again, located on the upper side 1*a* of the ski, the basic body being connected to the ski 1 by screws (not shown). The basic body 307 has a front stop surface 321 and a rear stop surface 322. On the front section 4*a* of the stiffening device 4, a hand lever 320 is articulated on a horizontal transverse pin 319. A changeover lever 323 is mounted in an articulated manner on the underside and in the central region of said hand lever. A stop body 324 is mounted in an articulated manner on that side of the changeover lever 323 which is remote from the hand lever 320. The parts 319 to 324 thus form a type of toggle-lever or force transmission mechanism. Depending on whether, with the hand lever 320 open, the changeover lever 323 is pivoted to make the stop body 324 swing in the direction of the front stop surface 321 or of the rear stop surface 322, the action of pushing down the handlever 320, by virtue of the toggle-lever mechanism, i.e. the parts 319 to 324, being subjected to stress, results in the front section 4*a* of the stiffening device 4 being moved either towards the basic body 307, see arrow $P_1$, or in the opposite direction, see arrow $P_2$, this permitting the bidirectional setting of the level of convexity $h_2$ and $h_3$ of the ski according to FIGS. 2 and 3. If the hand lever 320 is not actuated, then, irrespective of the position of the stop body 324, the control mechanism 306 remains in the neutral position, as is represented in FIGS. 15 and 16. An internal thread with a screw-bolt located therein may be provided in the stop body. Depending on how far the screw-bolt projects out of the stop body towards the respective stop surface, the size of the displacement of the stiffening device 4 is thus changed.

Figure 17:
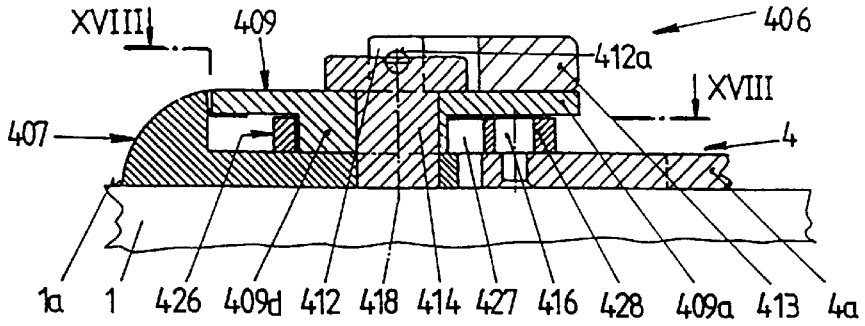
FIG. 17 shows a section of a fifth exemplary embodiment of the control mechanism along line XVII—XVII of FIG. 18.
Figure 18:
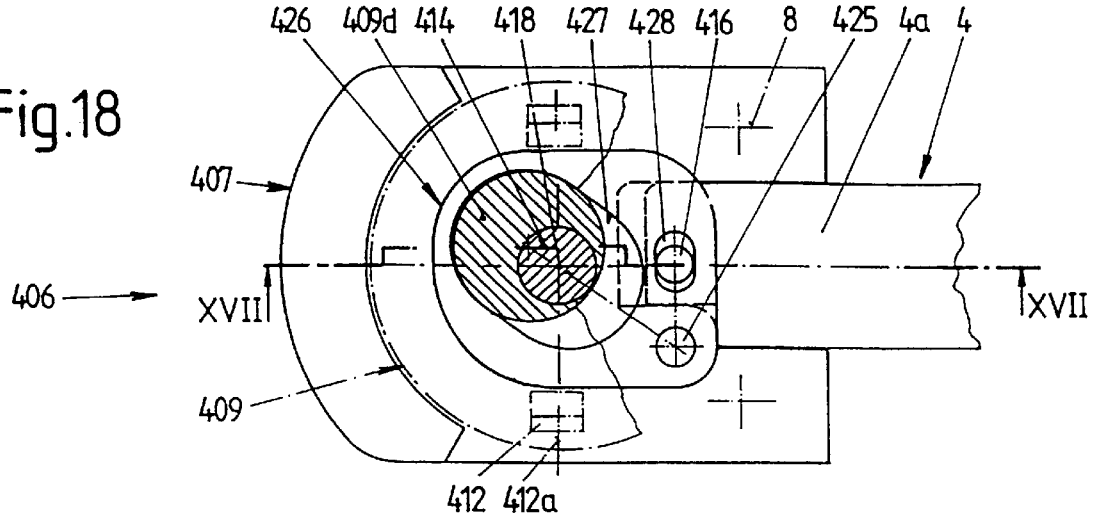
FIG. 18 shows a section of the fifth exemplary embodiment of the control mechanism along line XVIII—XVIII of FIG. 17.

In the fifth embodiment of the control mechanism 406 according to FIGS. 17 and 18, a swing-action lever 413 is mounted in a pivotable manner in a pivot bearing 412, on the transverse pin 412*a* thereof, on the top part 409*a* of the eccentric body 409. The eccentric body 409 acts as a force-transmission mechanism. An intermediate piece 426 is provided with a first slot 427, into which the eccentric part 409*d* engages. The basic body 407 is provided with a pivot pin 425, around which the intermediate piece 426 can carry out pivoting movements. A driver 416 of the front section 4*a* of the stiffening device 4 is guided with play in a second slot 428 of the intermediate piece 426. If rotation of the swung-out swing-action lever 413 then causes the eccentric body 409 to rotate about the vertical axis 418 of the centering bolt 414, the eccentric part 409*d* describes an eccentric circular arc with its center point. The intermediate piece 426 is carried along by the eccentric part 409*d*, which moves along the slot 427, and thus carries out a rotational movement around the pivot pin 425. The driver 416 slides in the second slot 428 and thus displaces the stiffening device 4 in its axial direction. In accordance with the direction of rotation of the swing-action lever 413, the distance between the driver 416 and the basic body 407 is either increased or reduced, and the stiffening device 4 is subjected to compressive loading or tensile loading, this bringing about the bidirectional change in the level of convexity of the ski (see FIGS. 2 and 3).

Figure 19:
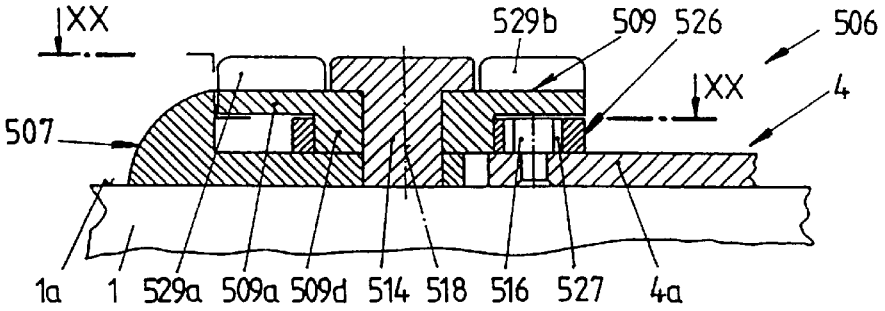
FIG. 19 showing a longitudinal section of a sixth variant of a control mechanism along line XIX—XIX of FIG. 20.
Figure 20:
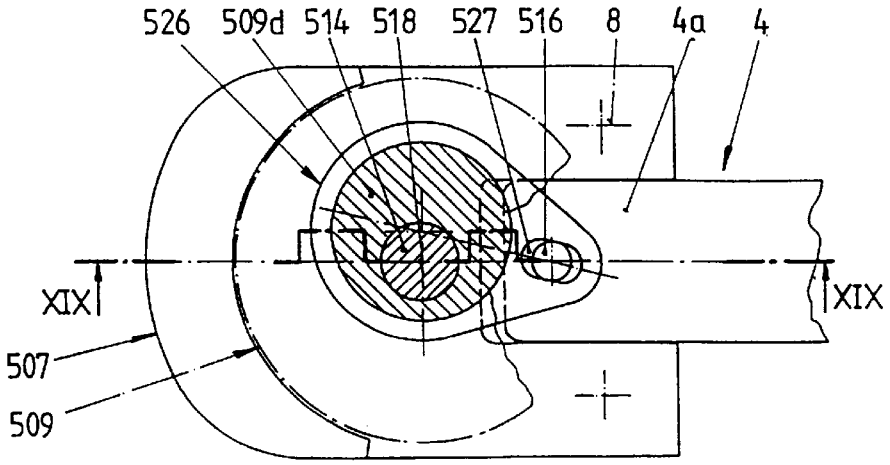
FIG. 20 shows a section of the sixth variant of a control mechanism along line XX—XX of FIG. 19.

In the sixth embodiment of the control mechanism 506 according to FIGS. 19 and 20, a basic body 507 is fastened on the upper side 1*a* of a ski 1 by means of screws 8 which are only schematically indicated. Likewise, the front section 4*a* of the stiffening device 4 is fitted in a sliding manner on the upper side 1*a* of the ski, said front section having a firmly connected driver 516 at its end nearest the basic body 507. Mounted in the basic body 507 is the centering bolt 514 which has the vertical axis 518 and, in turn, serves to mount the eccentric body or force transmission mechanism 509. At least one grip piece 529*a*, 529*b* is located on the top part 509*a* of the eccentric body 509, and is fixed to the latter. The grip piece 529*a*, 529*b*, permits easy operation of the control mechanism 506. The eccentric part 509*d* is arranged eccentrically with respect to the vertical axis 518 of the centering bolt 514, about which vertical axis the eccentric body 509 rotates when the grip piece 529 is actuated. According to FIG. 19, the intermediate piece 526 is coupled to the eccentric part 509*d*. Furthermore, the driver 516 mounted in the front section 4*a* engages with play into a slot 527 of the intermediate piece 526. By virtue of rotation with the grip piece 529, the eccentric body 509 is rotated about the vertical axis 518, as a result of which the center point of the eccentric part 509*d* carries out an eccentric circular movement. The intermediate piece 526, which is coupled to the eccentric part 509*d*, follows movement thereof and, once the play between the slot 527 and the driver 516 has been overcome, displaces the front section 4*a* of the stiffening device 4 via the driver 516. In accordance with the selected direction of rotation, the distance between the basic body 507 and the front section 4*a* of the stiffening device 4 is either increased or reduced, this bringing about the bidirectional change in the level of convexity of the ski.

Figure 21:
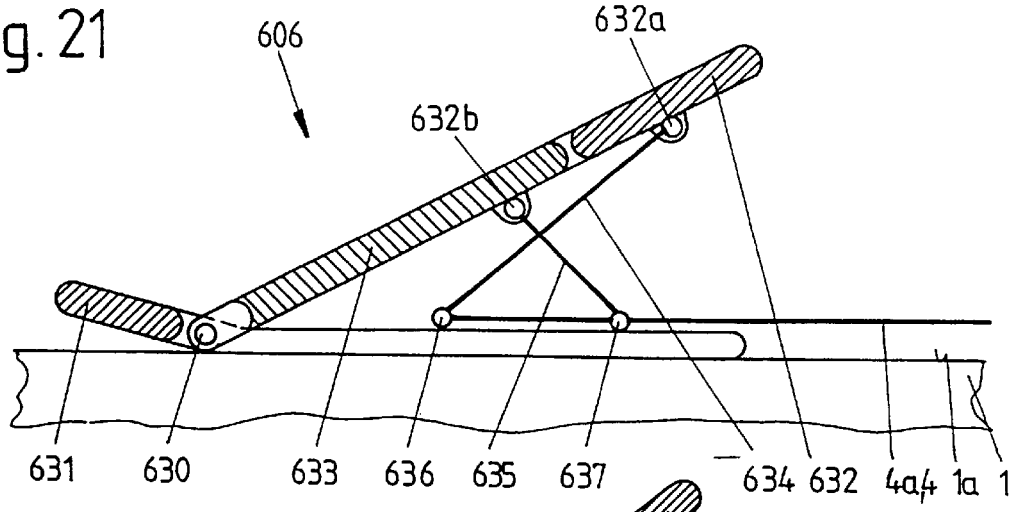
FIGS. 21, 22 and 23 show a seventh variant of the control mechanism in schematic representations.
Figure 22:
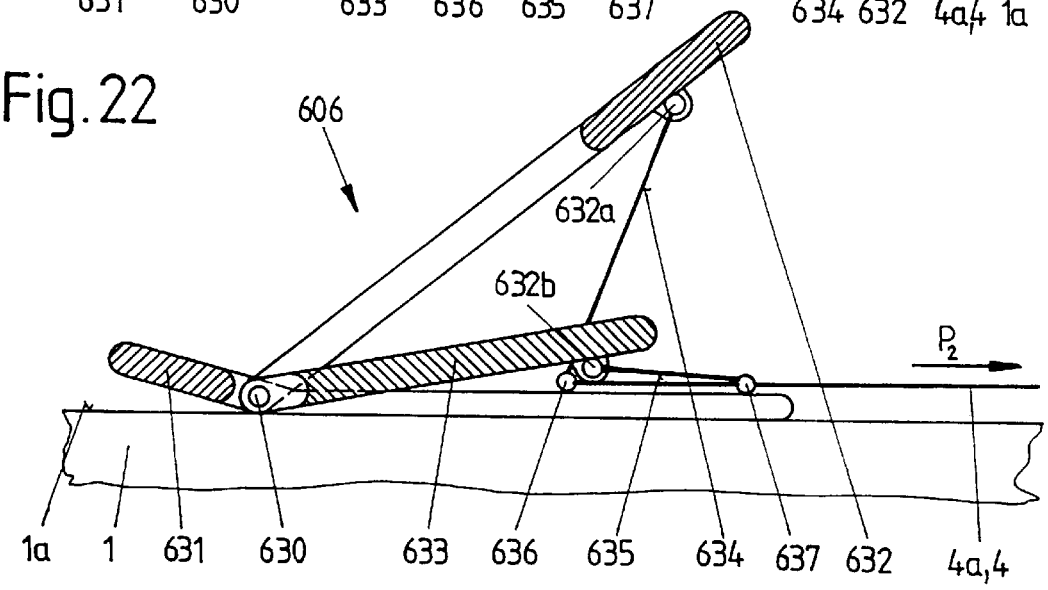
Figure 23:
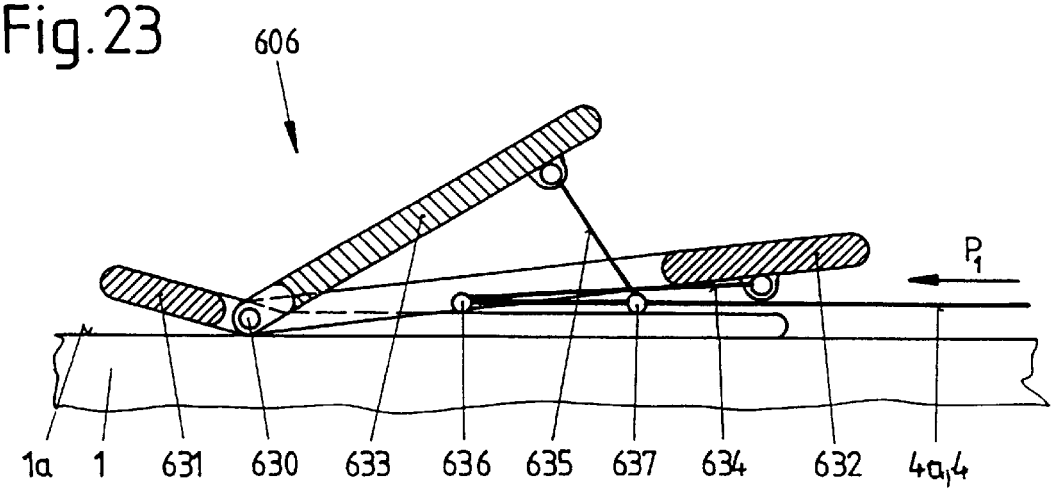

In the seventh variant of a control mechanism 606 according to FIGS. 21, 22 and 23, a pin 630 mounted on the ski 1 in a support (not shown) is arranged on the upper side 1*a* of the ski 1. A neutral lever 631, a tension lever 632 and a compression lever 633 are fastened in a pivotable manner on said pin 630. A tension connection lever 634 is mounted in a rotatable manner on the tension lever 632, and the other end of said tension connection lever is connected in a rotatable manner to the front section 4*a* of the stiffening device 4 by a tension bolt 636. A compression connection lever 635 is articulated on the compression lever 633 and is likewise connected in a rotatable manner, at its end remote from the compression lever 633, to the front section 4*a* of the stiffening device 4 by a compression bolt 637. The tension connection lever 634 and cpmpression connection lever 635 each act as part of the force-transmission mechanism. If the tension lever 632 or the compression lever 633 is in the active position, then the neutral lever 631 serves, before the actuation of the other lever 633 or 632, to move said other lever into the neutral position in order to prevent tension lever 632 and compression lever 633 being moved simultaneously into the active position. After prior actuation of the neutral lever 631 the compression lever 633, according to FIG. 22, has then been pressed downwards. The compression connection lever 635 thus moves into an approximately horizontal position, as a result of which, via the compression bolt 637, the front section 4*a* of the stiffening device 4 is subjected to compressive loading, see arrow $P_2$, and the level of convexity of the ski is increased to $h_2$, in accordance with FIG. 2. If the level of convexity is then to be reduced, first of all the neutral lever 631 is actuated, as a result of which the compression lever 633 is moved into the non-active state and the front section 4*a* of the stiffening device is freed of stress. By virtue of the tension lever 632 being pressed down, the tension connection lever 634 moves into an approximately horizontal position and, by the displacement of the tension bolt 636 in the direction of the arrow $P_1$, subjects the front section 4*a* of the stiffening device 4 to tensile loading, as a result of which the level of convexity of the ski is reduced to $h_3$, according to FIG. 3.

Figure 24:
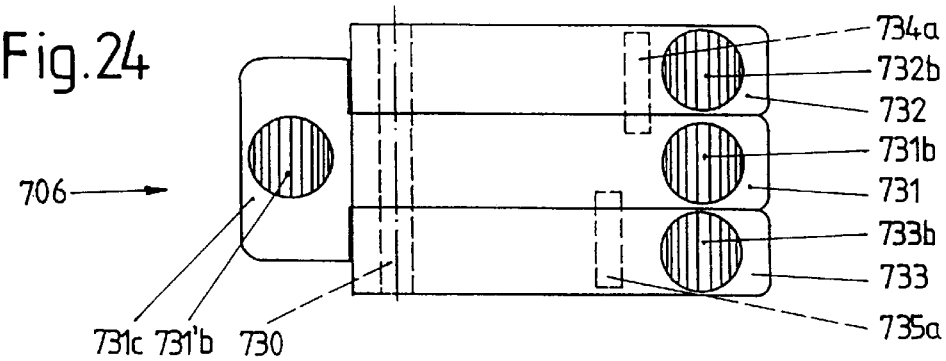
FIGS. 24 to 27 show, as eighth embodiment, a modification of the seventh variant of a control mechanism.
Figure 25:
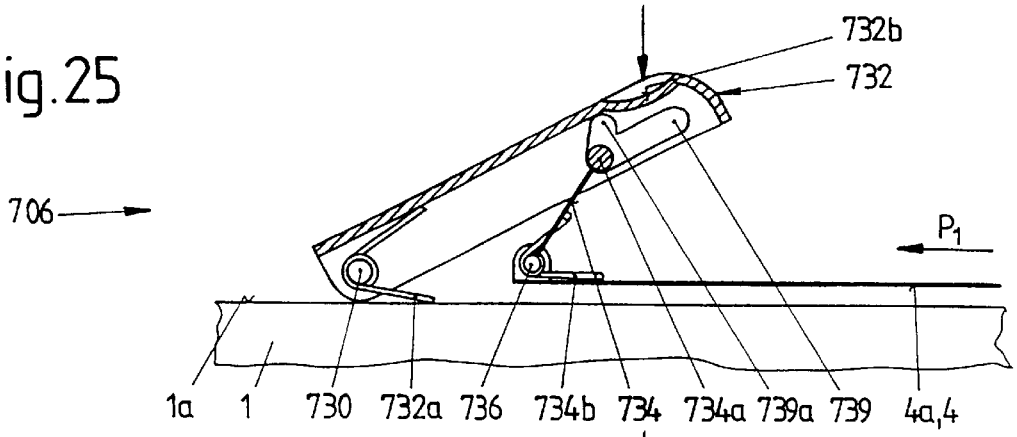
Figure 26:
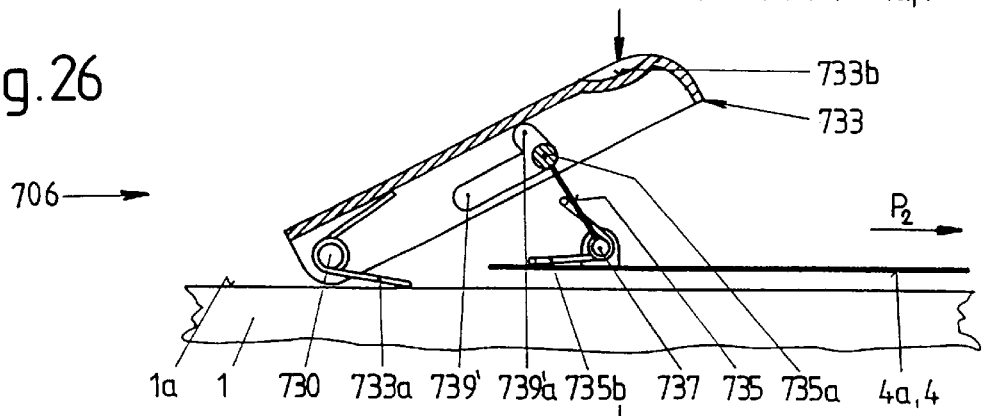
Figure 27:
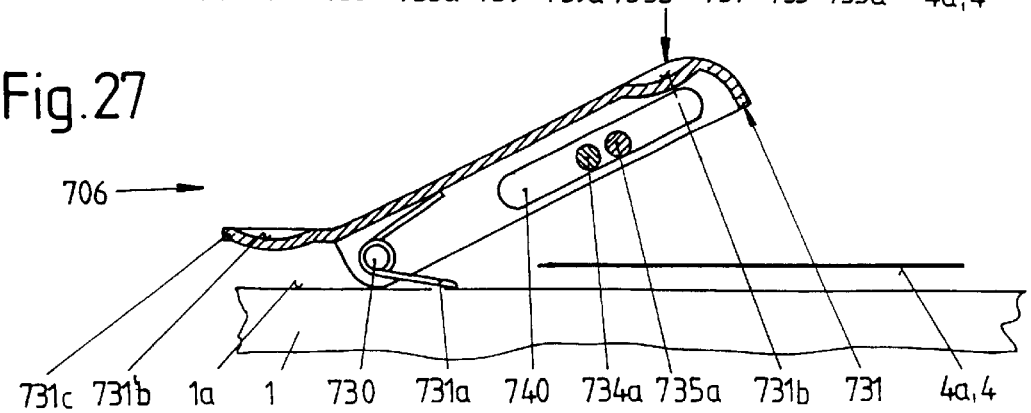

The eighth variant of the control mechanism 706 according to FIGS. 24 to 27 is a further development of the seventh variant above. The transverse pin 730 is mounted, in a support (not shown), on the upper side 1*a* of the ski 1, there being arranged in a pivotable manner on said transverse pin the neutral lever 731 with an associated opening spring 731*a*, the tension lever 732 with an associated opening spring 732*a* and the compression lever 733 with an associated opening spring 733*a*. As FIGS. 24 to 27 show, a tension bolt 736 and a compression bolt 737 are fastened on the front section 4*a* of the stiffening device 4 such that they run essentially at right angles with respect to the longitudinal axis of the stiffening device 4. A tension connection lever 734 is articulated on the tension bolt 736*a* transverse bolt 734*a* at the upper end section of said tension connection lever, is engaged into a hook-shaped recess 739, provided with hook portion 739*a*, of the tension lever 732 and into a longitudinal groove 740 of the neutral lever 731 (see FIGS. 24 and 27), and a leg spring 734*b* making the tension connection lever 734 abut against the hook-shaped recess 739 of the tension lever 732. The tension connection lever 734 and its transverse bolt 734*a* may act as the force-transmission mechanism. According to FIG. 26, a compression connection lever 735 is connected in an articulated manner to the compression bolt 737. Said compression connection lever engages, by means of its transverse bolt 735*a*, into a hook-shaped recess 739', provided with a hook 739'*a*, of the compression lever 733 and into the longitudinal groove 740, as is represented in FIGS. 24 and 27, of the neutral lever 731. The compression connection lever 735 and its transverse bolt 735*a* may act as the force-transmission mechanism. In addition, a leg spring 735*b* makes the compression connection lever 735 abut against the hook-shaped recess 739' of the compression lever 733. For easier actuation, the tension lever 732 and compression lever 733 are each provided with a depression 732*b*, 733*b*, and the neutral lever 731 is provided with two depressions 731*b*, 731'*b*, in order, for actuation with a ski pole, to provide a better grip for the tip of said ski pole. In this arrangement, the second depression 731'*b* of the neutral lever 731 is formed on a continuation part 731*c*. The advantage of this configuration lies in the fact that, irrespective of which of the three levers, neutral lever 731, tension lever 732 or compression lever 733, has actually been actuated, said levers always come to be located horizontally, and there is thus no risk of dirt build-up.

If the neutral lever 731 is moved into the horizontal position by pressure being exerted on the depression 731*b*, then tension lever 732 and compression lever 733 likewise move into the horizontal position, since the transverse bolt 734*a* of the tension connection lever 734 and the transverse bolt 735*a* of the compression connection lever 735 are guided in the longitudinal groove 740 of the neutral lever 731. The control mechanism 706 remains in its non-active position. If the tension lever 732 is pressed downwards, then the hook 739*a* of the hook-shaped recess 739 of the tension lever 732 comes into engagement with the transverse bolt 734*a* of the tension connection lever 734. By virtue of the tension connection lever 734 becoming active, the front section 4*a* of the stiffening device 4 moves in the direction indicated in FIG. 25 by the arrow $P_1$. compression lever 733 and neutral lever 731 likewise come to be located horizontally without exerting any action. When the compression lever 733 is actuated, the hook 739'*a* of the hook-shaped recess 739' of the compression lever 733 comes into engagement with the transverse bolt 735*a* of the compression connection lever 735. Consequently, the front section 4*a* of the stiffening device 4 moves in the direction indicated in FIG. 26 by the arrow $P_2$. As a result of the coupling with the longitudinal groove 740 of the neutral lever 731, tension lever 732 and neutral lever 731 likewise assume a horizontal position.

In order to move the tension lever 732 or compression lever 733 out of the horizontal, non-active position and into its active position, pressure is exerted on the continuation part 731*c* of the neutral lever 731, with the result that the latter, pivoting around the transverse pin 730, causes the desired operation via one of the transverse bolts 734*a* or 735*a*.

In the description which now follows of spring systems of various configurations, use is made of helical springs, which, however, for the sake of simplicity, have occasionally been called springs.

Figure 28:
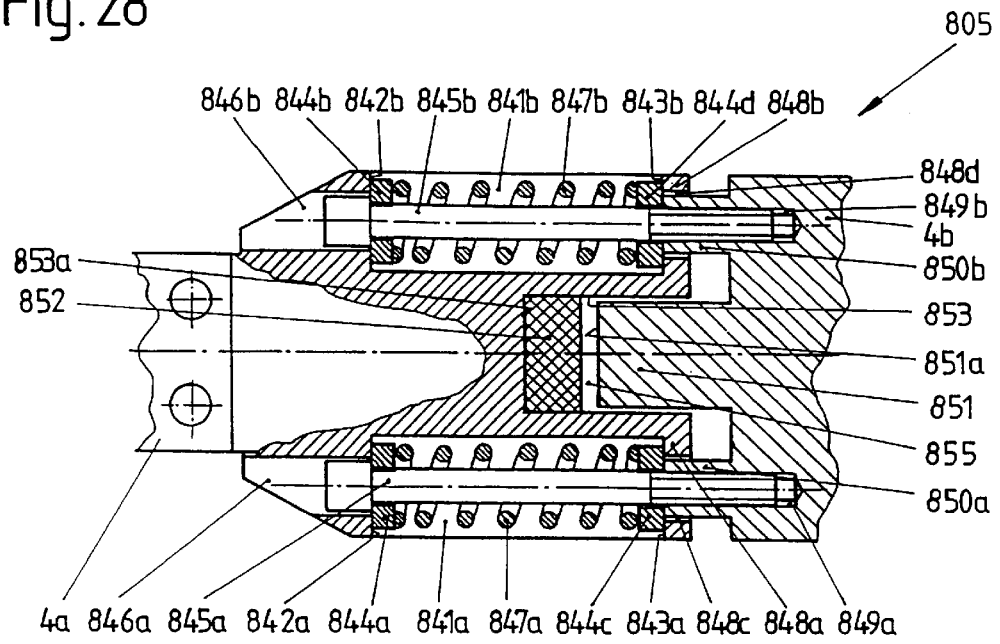
FIGS. 28 to 31 show four different embodiments of spring systems in plan view, partially in section.

As can be seen from a first configuration of a spring system according to FIG. 28, the spring system 805 represented there is arranged between the front section 4*a* and the rear section 4*b* of the stiffening device 4, the rear section 4*b* being fastened on the upper side 1*a* of the ski by screws (not shown).

Two clearances 841*a* and 841*b* are located on the front section 4*a* of the stiffening device 4, in symmetrical arrangement with respect to the longitudinal axis thereof. The clearances 841*a*, 841*b* each have a front stop surface 842*a*, 842*b* and a rear stop surface 843*a*, 843*b*. An associated washer 844*a*, 844*b* and 844*c*, 844*d* abuts against each stop surface 842*a*, 842*b* and 843*a*, 843*b*. In each case a flange 848*a*, 848*b*, each of which has a flange bore 848*c*, 848*d*, is formed on the rear end region of the front section 4*a* of the stiffening device 4, likewise in a symmetrical arrangement with respect to the longitudinal axis thereof.

Furthermore, a helical spring 847*a*, 847 *b* is arranged in each of the two clearances 841*a*, 841*b*, said springs being supported, by their end sections, against the associated washers 844*a*, 844*c* and 844*b*, 844*d*.

Formed in the rear section 4*b* of the stiffening device 4 are internal threads 849*a*, 849*b*, into which the threaded section of a first screw 845*a* and the threaded section of a second screw 845*b*, respectively, are screwed. The heads of the screws 845*a*, 845*b* are guided in a longitudinally movable manner in a head bore 846*a*, 846*b* of the front section 4*a* of the stiffening device 4. The rear section 4*b* of the stiffening device 4 is provided on both sides with a forwardly oriented protrusion 850*a*, 850*b*. Said protrusions 850*a*, 850*b* pass through the flange bores 848*c*, 848*d* of the flanges 848*a* and 848*b*, respectively, and abut, by their end sections, against the associated washers 844*c*, 844*d* and are in alignment with the rear stop surfaces 843*a*, 843*b*.

Formed at the end of the front section 4*a* of the stiffening device 4 which faces the rear section 4*b* of the stiffening device 4 is a clearance 853 in which a projecting nose 851, provided with an end surface 851*a*, of the rear section 4*b* of the stiffening device 4 is arranged in a longitudinally movable manner. An elastic block 852 is arranged between the end surface 851*a* of the nose 851 and a rear wall 853*a* of the clearance 853. In the neutral position of the control mechanism in accordance with FIG. 1, a gap 855 remains between the elastic block 852 and the end surface 851*a* of the nose 851.

This spring system 805 functions as follows. If the front section 4*a* of the stiffening device 4 is moved to the right by the control mechanism, the stiffening device 4 is subjected to compressive loading and the level of convexity of the ski 1 is increased in accordance with FIG. 2. In this arrangement, the gap 855 between the elastic block 852 and the end surface 851*a* of the nose 851 is reduced counter to the force of the springs 847*a*, 847*b* compressed by the common displacement of the stop surfaces 842*a*, 842*b* and the washers 844*a*, 844*b* abutting against these, the washers 844*c*, 844*d*, furthermore, abutting against the protrusions 850*a* and 850*b*. As the movement continues, the force action of the springs 847*a*, 847*b* is supplemented by that force which results from the compression of the elastic block 852 between the rear wall 853*a* of the clearance 853 and the end surface 851*a* of the nose 851. The heads of the screws 845*a*, 845*b* move in the associated head bores 846*a*, 846*b* of the front section 4*a*, and the flanges 848*a*, 848*b*, with their bores 848*c*, 848*d*, are also displaced beyond the protrusions 850*a*, 850*b*. The combination of the springs 847*a*, 847*b* with the elastic block 852 achieves a characteristic for the entire spring system 805 which is selected by the designer to correspond to the respective requirements.

With a movement of the front section 4*a* of the stiffening device 4 to the left, on the other hand, the stiffening device 4 is subjected to tensile stressing, which corresponds to a reduction in the level of convexity of the ski 1 in accordance with FIG. 3. In the case of this direction of movement, the elastic block 852 is non-active in each position of the actuated spring system 805, since the gap 855 is increased.

The springs 847*a*, 847*b* are compressed between the washers 844*a*, 844*c* and 844*b*, 844*d* by virtue of the flanges 848*a*, 848*b* being displaced, the protrusions 850*a*, 850*b* moving away from the associated washers 844*c*, 844*d*.

Figure 29:
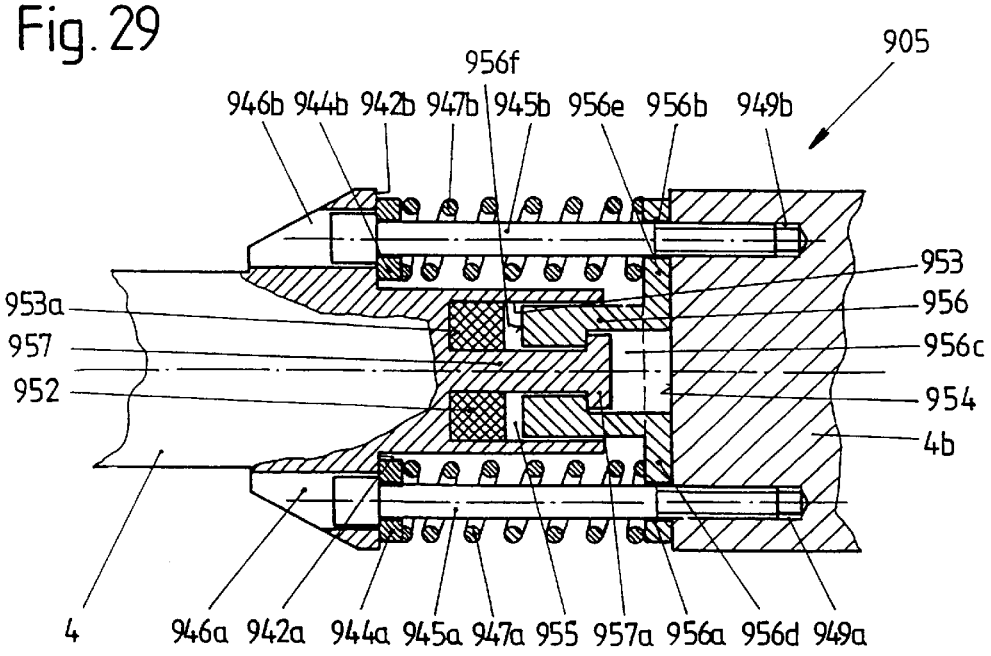

As a comparison of FIGS. 28 and 29 shows, the second embodiment according to FIG. 29 constitutes a modification of the embodiment according to FIG. 28. In accordance with FIG. 29, a rearwardly oriented protrusion 957 of the front section 4*a* passes through the elastic block 952 of the spring system 905, which protrusion engages, by means of its widened end section 957*a*, in a positively locking manner into a flange body 956 which is provided with an end surface 956*f* and, by its two flanges 956*d*, 956*e*, abuts against the end surface 954 of the rear section 4*b* of the stiffening device 4. The springs 947*a*, 947*b* abut, at one end, against the front washers 944*a*, 944*b* and, at the other end, directly against the flanges 956*d*, 956*e* of the flange body 956, the screws 945*a*, 945*b* passing through the flange body 956 along the two flange-body bores 956*a*, 956*b*.

If the front section 4*a* of the stiffening device 4 is made to move to the right via any above-mentioned control mechanism, thus resulting in an increase in the level of convexity of the ski 1 in accordance with FIG. 2 and in the stiffening device 4 being subjected to compressive loading, then the gap 955 between the elastic block 952 and the end surface 956*f* of the flange body 956 is reduced, while the helical springs 947*a*, 947*b* are compressed, by the front section 4*a* of the stiffening device 4, between the washers 944*a*, 944*b* and the flanges 956*d*, 956*e*. When the elastic block 952 comes to abut against the flange body 956, once the gap 955 has been bridged, the characteristics of the helical springs 947, 947*a* and of the elastic block 952 are superimposed, thus achieving a characteristic for the entire spring system 905 which is favorable for this direction of actuation of the stiffening device 4*a*.

With the front section 4*a* of the stiffening device 4 being moved to the left by a control mechanism, the stiffening device 4 is subjected to tensile loading, and the level of convexity of the ski 1 is thus changed in accordance with FIG. 3. The gap 955 between the elastic block 952 and the flange body 956 remains constant, with the result that, in the case of this direction of movement, the elastic block 952 does not take effect. Via the clearance 956*c* of the flange body 956, the end section 957*a* of the protrusion 957 carries along said flange body with it, as a result of which the two flanges 956*d*, 956*e* compress the helical springs 947*a*, 947*b*, as a result of which the tensile loading, which has already been indicated, takes place.

Figure 30:
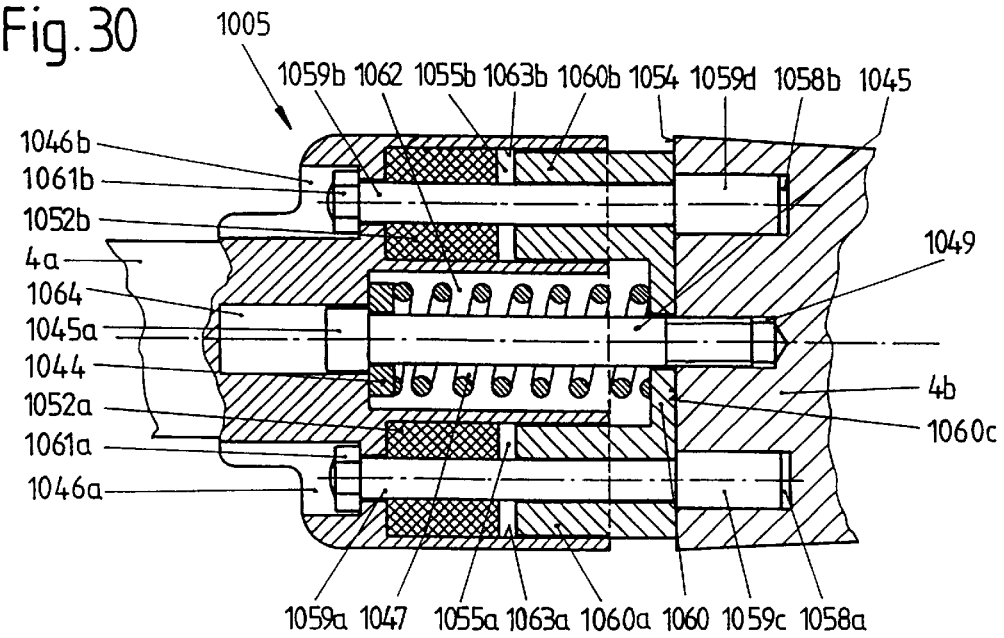

In the third exemplary embodiment of the spring system 1005 according to FIG. 30, the rear section 4*b* of the stiffening device 4 is provided, along its axis, with an internal thread 1049 into which a screw 1045 is screwed. Abutting against the head 1045*a* of the screw 1045 is a washer 1044, against which one end of a helical spring 1047 is supported. The second end of the helical spring 1047 rests against a driver element 1060, and that side of the latter which is remote from the helical spring 1047, i.e. the rear wall 1060*c*, abuts against the end surface 1054 of the rear section 4*b* of the stiffening device 4. The screw 1045 does not provide any marked resistance against any movement of the driver element 1060. A recess 1064 in the front section 4*a* of the stiffening device 4 receives the head 1045*a* of the screw 1045, there being sufficient space, when the spring element 1005 is actuated, in order not to obstruct movements in the two directions.

Formed in the front section 4*a* of the stiffening device 4 are two depressions 1063*a*, 1063*b*, which are located symmetrically with respect to the longitudinal axis of said stiffening device. An elastic block 1052*a*, 1052*b* is inserted into each depression 1063*a*, 1063*b*.

The driver element 1060 has two symmetrically arranged projecting parts 1060*a*, 1060*b*. The projecting parts 1060*a*, 1060*b* project into the associated depressions 1063*a*, 1063*b*, the dimensions of both the projecting parts 1060*a*, 1060*b* and the associated elastic blocks 1052*a*, 1052*b* being selected such that, in the neutral position of the control mechanism in accordance with FIG. 1, there is a gap 1055*a* between the elastic block 1052*a* and the projecting part 1060*a* of the driver element 1060 as well as a gap 1055*b* between the elastic block 1052*b* and the projecting part 1060*b* of the driver element 1060. Side bores 1058*a*, 1058*b* are formed in the rear section 4*b* of the stiffening device 4 in order to receive driver bolts 1059*a*, 1059*b* which serve to guide the spring system 1005 and will be described in more detail.

At their end sections 1059*c*, 1059*d* which project into the respective side bore 1058*a*, 1058*b*, the driver bolts 1059*a*, 1059*b* have diameters which are enlarged with respect to the other transverse dimensions. At the end nearest the front section 4*a* of the stiffening device 4, each driver bolt 1059*a*, 1059*b* is provided with a nut 1061*a*, 1061*b* which can move in a head bore 1046*a*, 1046*b*. The driver bolts 1059*a*, 1059*b* pass through the elastic blocks 1052*a*, 1052*b*, the gaps 1055*a*, 1055*b* and the protrusions 1060*a*, 1060*b* of the driver element 1060 with play—as seen from the front section 4*a* of the stiffening device 4, and, by their largest diameters, are mounted in a movable manner in the associated side bores 1058*a*, 1058*b* in the rear section 4*b* of the stiffening device 4.

With a movement of the front section 4*a* of the stiffening device 4 to the right, first of all, the gaps 1055*a*, 1055*b* between the elastic blocks 1052*a*, 1052*b* and the projecting parts 1060*a*, 1060*b* are reduced. At the same time, the helical spring, which is likewise displaced to the right by the front section 4*a*, is compressed between the driver 1060 and the washer 1044. From that position of the elastic blocks 1052*a*, 1052*b* in which the dimensions of the gaps 1055*a*, 1055*b* become equal to zero, the characteristic of the helical spring and the two characteristics of the elastic blocks 1052*a*, 1052*b* are superimposed, this resulting in a favorable characteristic for the entire spring system for a change in the level of convexity in accordance with FIG. 2.

With a movement of the front section 4*a* of the stiffening device 4 to the left, the front section 4*a* likewise displaces the driver bolts 1059*a*, 1059*b* to the left, this being achieved via the nuts 1061*a*, 1061*b* of said driver bolts. In turn, the driver bolts 1059*a*, 1059*b* carry along the driver element 1060 to the left by their enlarged end sections 1059*c*, 1059*d*. The dimensions of the gaps 1055*a*, 1055*b* remain unchanged, whereas the helical spring is compressed between the washer 1044 and the moving driver element 1060, this resulting in a change in the level of convexity of the ski 1 in accordance with FIG. 3.

Figure 31:
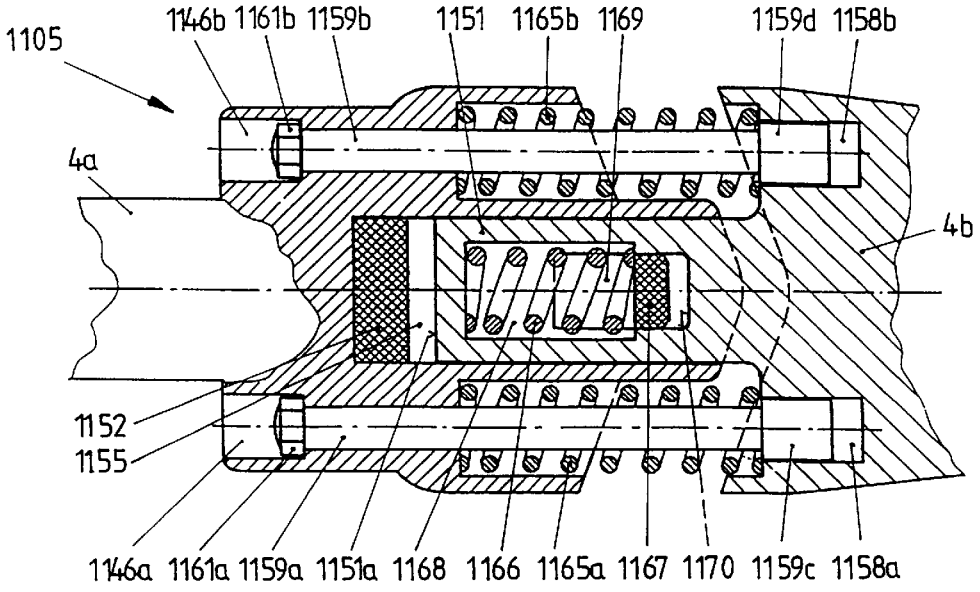

The fourth embodiment of a spring system 1105 according to FIG. 31 is achieved by combining the embodiments according to FIGS. 28 and 30, this resulting, however, in a mode of action which differs from the embodiment according to FIGS. 28 and 30. In the present embodiment, an elongate recess 1168 is formed in the nose 1151 of the rear section 4*b*, a spring 1166 being inserted into said recess. The front section 4*a* of the stiffening device 4 also has a separate recess 1169, a driver block 1167 being mounted at that end of the recess which faces the rear section 4*b* of the stiffening device 4. Furthermore, the elongate recess 1168 of the rear section 4*b* of the stiffening device 4 has a separate section 1170, in which the driver block 1167 is mounted in a freely movable manner. A spring 1165*a* and a spring 1165*b* abut, in a symmetrical arrangement, directly against both the front section 4*a* and the rear section 4*b* of the stiffening device 4. The two springs 1165*a*, 1165*b* are guided through the shanks of the driver bolts 1159*a*, 1159*b* and abut against the rear end sections 1159*c*, 1159*d*, these being configured in an enlarged manner with respect to the shank diameter of the driver bolts 1159*a*/1159*b*. The configuration of the head bores 1146*a*, 1146*b* with the nuts 1161*a*, 1161*b*, guided therein, of the driver bolts 1159*a*, 1159*b* and of the side bores 1158*a*, 1158*b* corresponds to that which has already been described.

With a movement of the front section 4*a* of the stiffening device 4 to the right, first of all the two springs 1165*a*, 1165*b* are compressed between the front section 4*a* and the rear section 4*b* of the stiffening device 4. The driver block 1167 moves to the right in the recess 1170. The helical spring 1166 is in the non-active state. When the gap 1155 between the elastic block 1152 and the end surface 1151*a* of the nose 1151 has been bridged, the elastic block 1152 also takes effect in accordance with its characteristics, this thus achieving, together with the characteristics of the helical springs 1165*a*, 1165*b*, the necessary favorable characteristics of the spring system 1105 for this direction of movement. This results in a change in the level of convexity of the ski 1 in accordance with FIG. 2.

If the front section 4*a* of the stiffening device 4 moves to the left, this results in a change in the level of convexity of the ski 1 in accordance with FIG. 3. This results in the fact that the driver block 1167 is carried along to the left, by the front section 4*a* of the stiffening device 4, along the recess 1169 of the front section 4*a*, the helical spring 1166 is compressed and, as a result, tensile forces are introduced into the stiffening device 4. The helical springs 1165*a*, 1165*b* are carried along by the rear, widened end sections 1159*c*, 1159*d* of the driver bolts 1159*a*, 1159*b*, these ends sliding in the side bores 1158*a*, 1158*b*. However, this results in the two outer helical springs 1165*a*, 1165*b* no longer abutting against the rear section 4*b* of the stiffening device 4, said springs thus being in the non-active state.

Unlike the previous configurations of spring systems, it is thus either the group of the outer helical springs 1165*a*, 1165*b* with the elastic block 1152, or the inner spring 1166 alone, which takes effect.

The invention is not restricted to the embodiments represented and described. Further variants are possible without leaving the framework of the invention. Thus, for example, combinations of the control mechanisms according to FIGS. 5 to 27 with the spring systems according to FIGS. 28 to 31 would be conceivable. It is also possible, and particularly favorable for assembly reasons, to combine those parts of the spring system which are associated with the front section 4*a* to give a separate unit, and to fasten said unit on the front section 4*a* of the stiffening device 4 (see FIG. 28). Furthermore, it would be possible to assign the spring-system parts the other way around to the two sections 4*a*, 4*b* and to arrange the control mechanism in the region of the heel-binding means.

In order to fasten the screw-bolt on the rear section of the stiffening device, use may also be made, instead of a screw-connection, of a bolt with a securing device, e.g. a transverse pin. The bolts could also be fastened, e.g. by injection molding, press fitting or snap fitting, in the stiffening device itself. Likewise, the head may be designed in one piece with the screw-bolts.

A further configuration according to the invention is distinguished in that the control mechanism is equipped with a device for displaying the degree of rigidity or the level of convexity of the sliding device, in which case either a marker is provided on the basic body and markings, preferably with measurements, are provided on the rotatable component or on the manipulation mechanism. The arrangement of the marker and that of the markings may also be changed around.

Furthermore, it is also within the framework of the invention to fit a combination of control mechanism 6 and stiffening device 4, in an expedient configuration and arrangement, on the upper side of a snowboard.

The embodiments of the invention in which an exclusive property or privilege is claimed are defined as follows:

1. An arrangement for changing at least one of hardness, elasticity and rigidity of a snow sliding device, the sliding device having an initial level of convexity in a non-loaded state which is predetermined during manufacture, comprising: a stiffening device fitted on the sliding device, said stiffening device having first and second sections and acting to change the level of convexity of said sliding device in a loaded state; a control mechanism fixed to the first section of the stiffening device for manually and continuously controlling action of said stiffening device; a manipulation means attached on said control mechanism for bidirectionally actuating said control mechanism; a spring system connecting said first and second sections of said stiffening device, said spring system having at least one spring, said spring having a first end section and a second end section; a force-transmission mechanism connected to the control mechanism and acted upon by the manipulation means, the manipulation means being actuable in one direction forcing said force-transmission mechanism in a second direction to actively tensile load said first section of said stiffening device increasing the level of convexity to a second level of convexity greater than the initial level of convexity, the manipulation means being actuable in a third direction forcing said force-transmission mechanism in a fourth direction to actively tensile load said stiffening device decreasing the level of convexity to a third level of convexity less than the initial level of convexity; a first force-transmission element fixed to said second section and being abutted by said first end section of said spring, and said second end section of said spring being supported against said first section of said stiffening device.

2. The arrangement according to claim 1, wherein said spring system has a second spring, said second spring having first and second end sections, and a second force-transmission element is fixed to said second section and extends between said first section of said stiffening device and said second end section of said second spring, said first end section of said second spring abutting said first section, and said second end section of said second spring abuts said second force-transmission element.

3. An arrangement for changing at least one of hardness, elasticity and rigidity of a snow sliding device, the sliding device having an initial level of convexity in a non-loaded state which is predetermined during manufacture, comprising: a stiffening device fitted on the sliding device, said stiffening device having first and second sections and acting to change the level of convexity of said sliding device in a loaded state; a control mechanism fixed to the sliding device for manually and continuously controlling action of said stiffening device, said control mechanism having an eccentric body which can be rotated about a vertical axis and having a top part, a bottom part, and a central force-transmission part which are offset with respect to one another, said bottom part being mounted in a base body fixed to the snow sliding device, said force-transmission part being an eccentric part, and said top part receiving a manipulation means, an elongate recess of said first section of the stiffening device receiving said force-transmission part; said manipulation means being attached on said control mechanism for bidirectionally actuating said control mechanism; a spring system connecting said first and second sections of said stiffening device, said spring system having at least one spring, said spring having a first end section abutting against said first section of said stiffening device and having a second end section acting against said second section of said stiffening device; the manipulation means being actuated in one direction and said force-transmission part being actuated to tensile load said first section of said stiffening device in another direction; and a force-transmission element connected to said second section and being abutted by said second end section of said spring.

4. The arrangement as claimed in claim 3, wherein the manipulation means has a hand wheel with a coupling pin, the coupling pin being received by a receiving location in the eccentric body, which receiving location is an elongate recess.

5. An arrangement for changing at least one of hardness, elasticity and rigidity of a snow sliding device, the sliding device having an initial level of convexity in a non-loaded state which is predetermined during manufacture, comprising: a stiffening device fitted on the sliding device, said stiffening device having first and second sections and acting to change the level of convexity of said sliding device in a loaded state; a control mechanism fixed to the sliding device for manually and continuously controlling action of said stiffening device; a manipulation means attached on said control mechanism for bidirectionally actuating said control mechanism; a spring system connecting said first and second sections of said stiffening device, said spring system having at least one spring, said spring having a first end section abutting against said first section of said stiffening device and having a second end section biasing said second section of said stiffening device; a force-transmission mechanism connected to the control mechanism and acted upon by the manipulation means , said force-transmission mechanism adjusting the stiffening device to adjust the level of convexity of said sliding device; a force-transmission element connected to said second section and abutting said second end section of said spring, said force-transmission element being arranged between the first section and the second section of the stiffening device and having two screw-bolts symmetrically arranged with respect to the longitudinal axis of the stiffening device respectively in clearances of the first section, said clearances being delimited in the longitudinal direction by front stop surfaces and rear stop surfaces, head bores being formed in the first section of the stiffening device, and flange bores being formed in flanges of the first section of the stiffening device, the first section having a further clearance in which an elastic block is arranged, the second section of the stiffening device having one forwardly oriented protrusion positioned on both sides of the second section, said protrusions pass through the flange bores, the second section of the stiffening device having a centrally projecting nose including an end surface and projecting into said further clearance of the first section of the stiffening device; and one of said springs being respectively arranged in each of the clearances, one of the screw-bolts passing through each of said springs, and the manipulation means actuating said first section in one direction and said force-transmission mechanism being actuated in another direction to tensile load said first section of said stiffening device.

6. The arrangement as claimed in claim 5, wherein internal threads are formed in order to receive a threaded section of the individual screw-bolts in the second section of the stiffening device, wherein the heads of the screw-bolts are guided in a longitudinally movable manner into the respective head bore of the first section of the stiffening device, and wherein one washer abuts against each stop surface respectively, end sections of the protrusions respectively abutting against the washers in a neutral position and being in alignment with the rear stop surfaces in the neutral position.

7. The arrangement as claimed in claim 5, wherein a gap is present between the elastic block and one of the end surface of the nose and the first section in a neutral position of the control mechanism.

8. In a snow sliding device having an initial curvature, the snow sliding device being elongate and having a lower surface for contact to the snow and an upper surface supporting a user's foot, a binding being fixed on the upper surface of the snow sliding device for securing a boot to the snow sliding device intermediate the two ends of the snow sliding device, a curvature altering means for changing curvature of the snow sliding device attached to the upper surface of the snow sliding device, said curvature altering means increasing the curvature of the snow sliding device to a second curvature from the initial curvature and decreasing the curvature of the snow sliding device to a third curvature from the initial curvature, the curvature altering means comprising:

a single control mechanism for selecting one of the initial, second, and third curvatures of the snow sliding device, the control mechanism being fixed to the upper surface of the snow sliding device;

first and second elongate stiffening members positioned on the upper surface of the snow sliding device, the first stiffening member having a first end connected to the control mechanism, a first end of the second stiffening member having first and second power transmission elements extending axially therefrom received in a second end of said first stiffening member, a second end of the second stiffening member being connected to the snow sliding device; and a spring system joining said second end of the first stiffening member to the first end of the second stiffening member, the spring system having first and second springs, the first and second springs each having a first end contacting the second end of the first stiffening member and having a second end respectively contacting the first and second power transmission elements.

9. The snow sliding device according to claim 8, wherein the first and second power transmission elements are elongate parallel to a longitudinal axis of the snow sliding device and are laterally spaced, and the first stiffening member has longitudinally extending first and second bores therein, the first and second bores respectively receiving the first and second power transmission elements therein.

10. The snow sliding device according to claim 9, wherein the first and second springs are respectively mounted coaxially on the first and second power transmission elements.

11. The snow sliding device according to claim 8, wherein the binding includes a toe binding and a heel binding, the first stiffening member extends beneath the toe binding, the second stiffening member extends beneath the heel binding, the control mechanism is positioned in front of the toe binding toward a front end of the snow sliding device, and the spring system is intermediate the toe and heel bindings beneath a boot secured in the binding.

* * * * *

UNITED STATES PATENT AND TRADEMARK OFFICE

CERTIFICATE OF CORRECTION

PATENT NO. : 5,924,717
DATED : July 20, 1999
INVENTOR(S) : Andreas Janisch, et. al.

It is certified that error appears in the above-identified patent and that said Letters Patent is hereby corrected as shown below:

Title page, item [73], Assignee: change "Schwechat, Australia" to --Schwechat, Austria--.

Signed and Sealed this

Eleventh Day of January, 2000

*Attest:*

Q. TODD DICKINSON

*Attesting Officer*

*Acting Commissioner of Patents and Trademarks*